US005090706A

United States Patent [19]

Hokanson

[11] Patent Number: 5,090,706

[45] Date of Patent: Feb. 25, 1992

[54] GAME APPARATUS

[76] Inventor: Harlen C. Hokanson, Box 25, Browerville, Minn. 56438

[21] Appl. No.: 352,185

[22] Filed: May 15, 1989

[51] Int. Cl.[5] ..... A63F 3/00

[52] U.S. Cl. ..... 273/248; 273/146; 273/290

[58] Field of Search ..... 273/146, 298, 249, 243

[56] References Cited

U.S. PATENT DOCUMENTS 887,464 5/1980 Creasey ..... 273/243
4,042,245 8/1977 Zarour ..... 273/249

FOREIGN PATENT DOCUMENTS 757509 9/1956 United Kingdom ..... 273/146

OTHER PUBLICATIONS

"Mathematical Games" Scientific American Magazine, Dec. 1970, pp. 110–111.

*Primary Examiner*—Benjamin Layno

*Attorney, Agent, or Firm*—John W. Adams

[57] ABSTRACT

Game apparatus including a game board having a central manually rotatable disk with color selection indicia thereon and a circular track surrounding the disk and having a plurality of division spaces thereon to define the playing path for each of the players. A set of dice are used, each die being uniformly colored with a different color such that each die corresponds to a color of the selection disk. The pre-selected numbering of each die are such that a non-transitive relationship exists between the dice. To define this relationship, a competive throwing of die is played where one player picks a die, then an opposing player picks a die from the remaining set of dice which both dice are thrown with the winner being the player who's die displays the higher number. Regardless of which die the first player picked, the opposing player can always pick a die having approximately a two-thirds probability of winning. The relative outcome of this competitive throwing of the dice determines the number of spaces and the direction the playing pieces move along the track.

5 Claims, 2 Drawing Sheets

FIG. 1
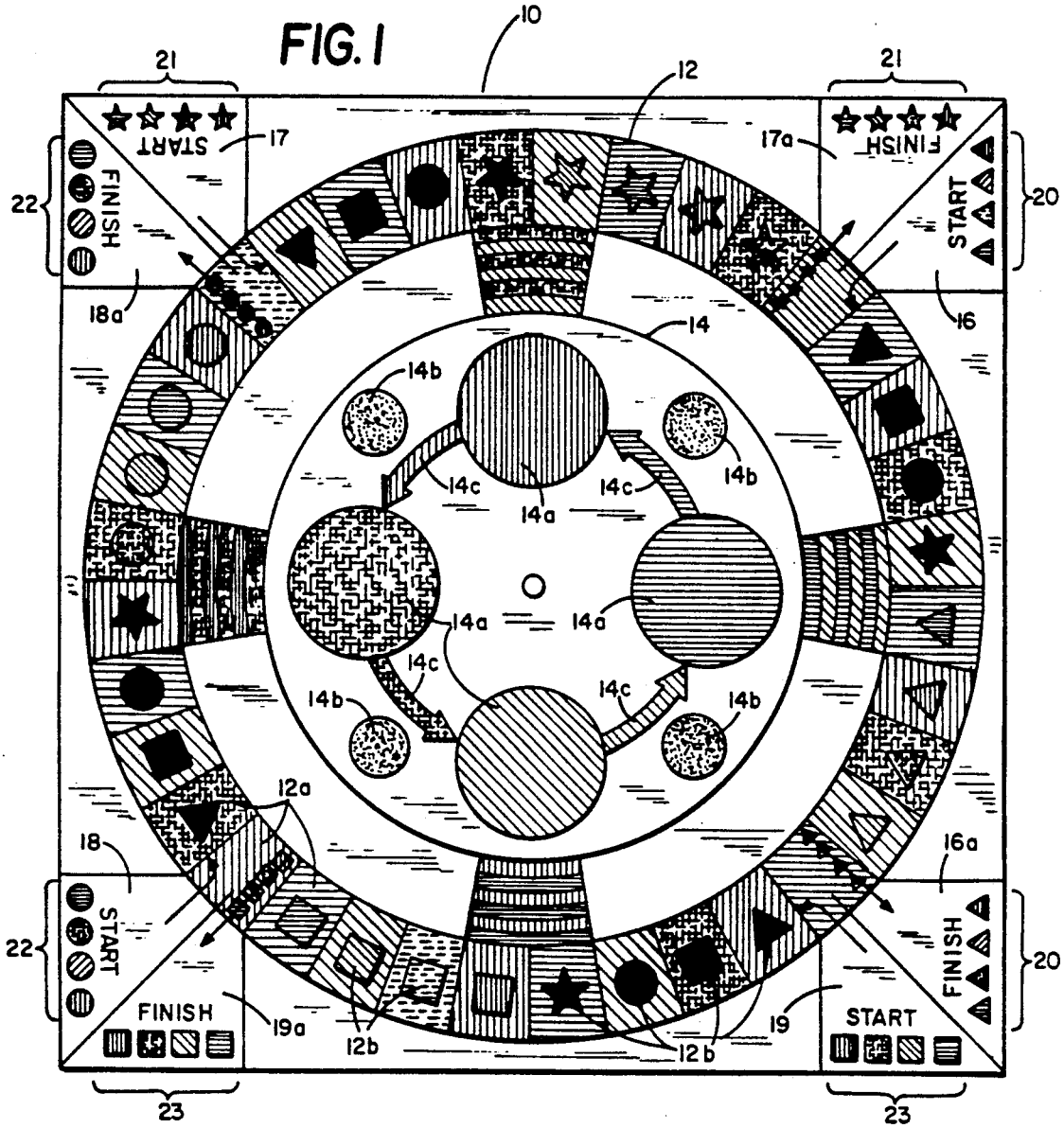
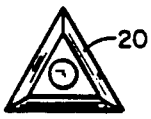
FIG. 2
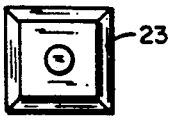
FIG. 4
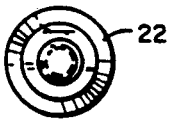
FIG. 6
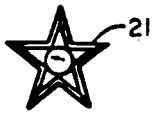
FIG. 8
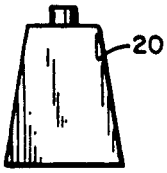
FIG. 3
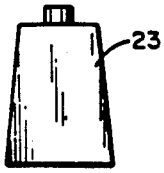
FIG. 5
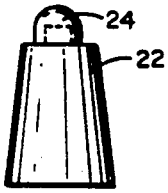
FIG. 7
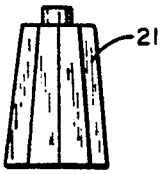
FIG. 9

GAME APPARATUS

BACKGROUND OF THE INVENTION

In the past, games have been produced which include various game boards and which rely on the throw of dice to determine the respective moves and winners of the game. Such games are represented by the following prior art patents which represent the only prior art presently known to the inventor herein and his attorney:

| | PRIOR ART | |
|---|---|---|
| U.S. Pat. No. | Issue Date | Patentee |
| 1,561,592 | November 17, 1925 | Bott |
| 4,247,114 | January 27, 1981 | Carroll |
| 4,449,710 | May 22, 1984 | Davis |
| 4,216,594 | August 12, 1980 | Farley |
| 2,745,667 | May 15, 1956 | Graham |
| 3,826,498 | July 30, 1974 | Monek |
| 4,089,527 | May 16, 1978 | Roth |
| 3,602,515 | August 31, 1971 | Seidman |
| 4,452,588 | June 5, 1984 | Smith |
| 1,481,628 | January 22, 1924 | Souza |
| 4,314,698 | February 9, 1982 | Van Dolah |
| 867,150 (British) | February 19, 1959 | Wynn |

PUBLICATIONS

Scientific American magazine, December 1970, (at pp. 110 and 111), Article entitled Mathmatical Games, by Martin Gardner.

It will be apparent that none of these prior art patents shows or remotely suggests the game board and dice combination embodying this invention.

SUMMARY OF THE INVENTION

This invention includes a game board having a rotatable color-coded selection disk surrounded by a segmented playing path also color-coded wherein the individual players each has a plurality of different shaped playing pieces to be moved on that player's playing path in accordance with the competitive throwing of the dice with the other respective players of the game wherein the color-coded dice respectively match the color-coded indicia on the rotatable disk. The disk include selected numbers on the surface thereof to establish a weighted probability of winning and losing with respect to head-to-head competition with the other dice.

DESCRIPTION OF THE DRAWINGS

FIG. 1 is a top plan view showing a game board with a rotatable disk mounted thereon embodying the invention;

FIGS. 2, 4, 6 and 8 are top plan views showing typical shapes of playing pieces;

FIGS. 3, 5, 7 and 9 are front elevational views of said pieces.

DETAILED DESCRIPTION OF THE PREFERRED EMBODIMENT

Figure 10:
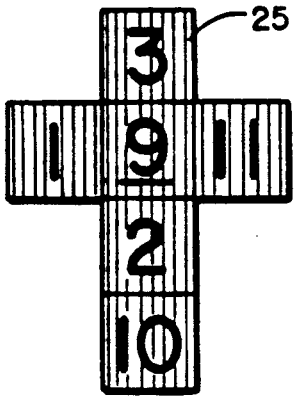
FIGS. 10 through 13 are views showing typical numbering arrangements for four six-sided color-coded dice which embody part of the game apparatus.

The game apparatus embodying this invention includes a game board 10 having a generally circular segmented game path 12 and a pivotally mounted color selection disk 14 located concentrically within the game path 12. The game path 12 is divided into a plurality of segments or squares 12*a*. Color indicators 14*a* are spaced around the disk and abrasive finger gripping areas 14*b* are provided on the disk 14 for progressively rotating the same into its successive positions. comparison direction arrows 14*c* determine which dice are to be compared after each throw. "Start" areas 16, 17, 18, and 19 are provided in spaced relation around the outside circumference of the segmented game path 12. Designated "finish" areas 16*a*, 17*a*, 18*a*, and 19*a* are respectively provided for each of the start areas 16–19.

Player designation shapes appear in each of the start and "finish" areas and are respectively designated by the numerals 20, 21, 22, and 23. Each player has four different colored playing pieces or markers all of which are respectively similar in shape to the shapes of the identifying player identification shapes 20–23 shown on the start and finish areas of the player board. Each square 12*a* is color-coded and also has a specific symbol shape 12*b* which selectively matches the designated player identification shapes 20–23, as shown in FIG. 1. A removable black cap 24 is provided for each playing piece until that piece passes its finish area.

The dice used for this game are "non-transitive" color-coded dice. The dictionary definition for transitive (Webster's third New International Dictionary, unabriged) is "of or relating to a logical relationship between X, Y, and Z such that if X has a specified relation to Y and Y to Z then X has this relation to Z." With respect to the present game apparatus the color-coded dice 25–28 are non-transitive with respect to the other dice. The selection of the numbers on the respective faces of the red, yellow, green and blue dice respectively numbered 25–28 will produce the comparison percentages where approximately 61.1 percent of the time red will roll a higher number than yellow, yellow will roll a higher number than green, green will roll a higher number than blue, and also, blue will roll a higher number than red.

Figure 11:
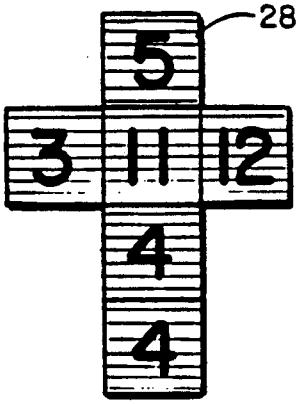
Figure 12:
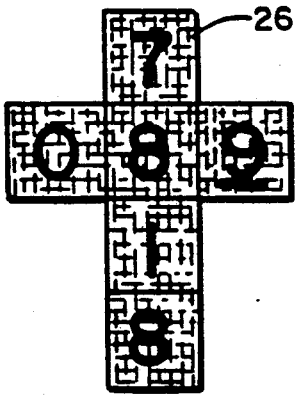
Figure 13:
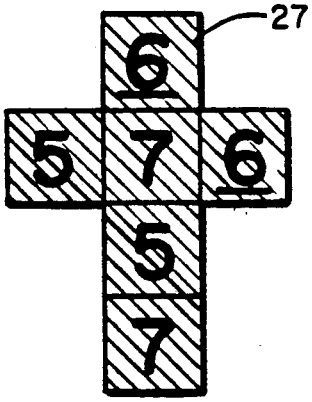

The non-transitive aspect of the different colored playing dice is described in the published article by Martin Gardner in the December 1970 issue of the Scientific American magazine at pages 110 and 111, and the basic relationships between applicant's non-transitive dice and the probability theory relating thereto is explained in that article. The selected numbers on the six sides of each die are set forth in FIGS. 10–13 of the drawings and according to Gardner's theory of probability the above-percentage should prevail approximately between each pair of dice being compared.

METHOD OF PLAYING THE GAME

Game Play for Four Players

1. All players roll their die and place it on the corresponding color of the center circle (red on red, Etc.) without changing the number rolled. After each roll, the number on each die is compared to the number of the die placed in the adjacent color indicator 14*a* located on his right (in the direction of the respective arrows 14*c*).

2. If 2 players roll the same number on their dice, neither of those players move their markers forward or backward. CAUTION: Always check for a tie between two dice before moving markers.

3. To move foreward a die must score HIGHER than the die TO WHICH ITS COLORED ARROW POINTS. COROLLARY: The player whose die scores lower, moves his/her marker backward.

4. Each player moves the same COLOR marker as the color of his/her die in each round.

5. Turn the center wheel ¼ turn COUNTER-CLOCKWISE after each player has completed his/her move. If the red die was rolled last round, that player now rolls the blue die and moves his/her blue marker.

6. Move the markers forward or backward the number of spaces shown on your die.

7. Three markers is the maximum any square may contain.

8. Two markers of the same COLOR can NOT occupy a square simultaneously.

9. If moving a marker the number of spaces shown on a die would violate any other rule, then don't move forward or backward at all.

10. Only one player at a time moves markers. All players do NOT move their markers simultaneously.

11. Players take turns in a counter-clockwise direction.

12. Markers go around the game board in a clockwise direction.

13. Always count the square that's adjoining the start/finish area when leaving the start area.

14. Use the black cap on all marker until each has gone at least one space (in clockwise direction) past its designated finish area, then remove it.

15. If when moving forward or backward a (for example) blue triangular marker stops on a blue square containing a black triangle, the player will move the marker FORWARD (clockwise) to the next BLACK triangle. In this example the marker would stop on the red square containing a black triangle.

MOVING INTO THE FINISH AREA

1. A marker can NOT enter the finish ares until it has gone PAST its designated finish area. Remove the black cap only when PAST the finish area.

2. Once a marker has gone past its finish area it may enter the finish area while moving FORWARD or BACKWARD.

3. There are 2 squares for each marker that will allow it to move into the finish area:

A. The square that's adjacent to the finish area. (It contains 4 small colored symbols that match your markers shape).

B. The 4 squares next to each finish area (in a counter-clockwise direction) each allow one marker to move into the finish area. The marker goes directly to the finish area if, for example, the blue triangular marker stops on the blue square containing a blue triangle.

4. Markers can NOT stop on the square adjacent to the finish area (and thereby enter the finish area) if that square already contains a marker of the same color.

INSTRUCTIONS FOR LESS THAN FOUR PLAYERS

One Player same as for four players except that the player will roll two dice. The player rolls the die being used to determine the move of the marker plus the next color die that the arrow 14c points to. EXAMPLE: if the red die is being used to determine the move of the marker, roll the yellow die also and compare numbers to determine distance and direction of marker movement.

Two Players

Same as for four players except that each player will roll two dice. Roll the die being used to determine marker movement plus the die to its left (clockwise). EXAMPLE: Player #1 will roll red and blue, player #2 will roll green and yellow. In the next round player #1 will roll blue and green and player #2 will roll yellow and red, etc.

Three Players

Same as for four players except that one player will roll two dice. The player to the right of the side not being used will roll his/her die plus the die not being used to determine marker movement.

what is claimed is:

1. Game apparatus comprising:

a game board having a game path formed thereon with a plurality of segmented divisions formed therein, each division having a player starting location and a finish location with a segmented intermediate playing path therebetween, a specified number of markers having player identifying shapes, each player having the same number of markers all of which have the same shape but the markers for each player having different colors, a color selection disk having color-identifying indicators thereon, a number of different colored dice corresponding to the number of players and the the respective colors of the markers as well as the respective color indicators of the rotatable color selection disk, and each die having a different selection of numbers applied to the respective faces thereof so that one die will display a higher number than another specific die a substantially predictable percentage of the time.

2. The structure set forth in claim 1 wherein the dice are non-transitive with each of the dice having different numbers on the respective faces thereof to produce approximately predictable results when compared head to head with another die specifically selected by the selection disk whereby one color die will be higher than another color die more than 50 percent of the time.

3. The structure set forth in claim 2 wherein the respective numbers of the dice will be higher than the numbers on another die approximately 60 percent of the time.

4. The structure set forth in claim 1 wherein the color selection disk is centrally mounted on a pivotal axis within the game path formed on the game board for manual movement from player to player during the progress of the game.

5. The structure set forth in claim 1 and a position identifying cap for each of the markers which is removable when the marker has moved past a pre-determined location on the game path.

* * * * *